US009329565B2

(12) United States Patent
Osaki

(10) Patent No.: US 9,329,565 B2
(45) Date of Patent: May 3, 2016

(54) IMAGE FORMING APPARATUS AND SHEET CONVEYING DEVICE

(71) Applicant: KYOCERA Document Solutions Inc., Osaka (JP)

(72) Inventor: Shuji Osaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/686,990

(22) Filed: Apr. 15, 2015

(65) Prior Publication Data

US 2015/0298931 A1 Oct. 22, 2015

(30) Foreign Application Priority Data

Apr. 16, 2014 (JP) ..... 2014-084279

(51) Int. Cl.
*B65H 31/02* (2006.01)
*G03G 21/16* (2006.01)
(Continued)

(52) U.S. Cl.
CPC ..... *G03G 21/1633* (2013.01); *B65H 29/125* (2013.01); *B65H 29/52* (2013.01); *B65H 29/60* (2013.01); *B65H 31/02* (2013.01); *B65H 43/00* (2013.01); *G03G 15/6552* (2013.01); *G03G 21/1638* (2013.01); *G03G 21/1695* (2013.01); *B65H 2301/4212* (2013.01); *B65H 2402/31* (2013.01); *B65H 2402/441* (2013.01); *B65H 2402/45* (2013.01); *B65H 2402/64* (2013.01); *B65H 2404/611* (2013.01); *B65H 2511/417* (2013.01); *B65H 2511/51* (2013.01); *B65H 2601/11* (2013.01); *B65H 2801/06* (2013.01); *G03G 2215/00421* (2013.01); *G03G 2215/00544* (2013.01)

(58) Field of Classification Search
CPC ..... B65H 2402/441; B65H 2402/45; B65H 2402/64; B65H 2404/142; B65H 2404/1421; B65H 2404/144; B65H 2404/1442; B65H 2404/152; B65H 2404/1521; B65H 2404/1544; B65H 2553/612; B65H 2601/11; B65H 2601/321; G03G 2221/1687; G03G 21/1633; G03G 21/1638; G03G 2402/5155
See application file for complete search history.

(56) References Cited

U.S. PATENT DOCUMENTS 7,811,018 B2 * 10/2010 Yasumoto ..... B41J 29/13 399/124
7,860,431 B2 * 12/2010 Kitamura ..... B41J 29/13 399/107

(Continued)

FOREIGN PATENT DOCUMENTS

JP 2000-153934 A 6/2000

*Primary Examiner* — Jeremy R Severson
(74) *Attorney, Agent, or Firm* — Studebaker & Brackett PC

(57) ABSTRACT

An image forming apparatus is configured to include an apparatus main body, further including an internal sheet discharge portion for ejection of a sheet having an image formed thereon; and a relay conveying unit, positioned in the internal sheet discharge portion, and configured to convey the sheet to a post-processing device. The relay conveying unit has: a body portion; a cover member positioned on a side surface of the body portion; a detection switch; and a hook positioned on the cover member. The body portion and cover member form a sheet conveying path, the cover member being turnable in vertical directions into opening and closing states, to open and form the sheet conveying path, respectively, as detected by the detection switch. The hook prevents the cover member from being turned from the closing state and switches the detection switch into an on state.

9 Claims, 9 Drawing Sheets

(51) Int. Cl.

| | |
|---|---|
| ***B65H 43/00*** | (2006.01) |
| ***B65H 29/12*** | (2006.01) |
| ***B65H 29/52*** | (2006.01) |
| ***B65H 29/60*** | (2006.01) |
| ***G03G 15/00*** | (2006.01) |

(56) References Cited

U.S. PATENT DOCUMENTS 9,052,682 B2 * 6/2015 Hisano ..... G03G 21/1633
2010/0158560 A1 * 6/2010 Watanabe ..... G03G 21/1633 399/110
2010/0239307 A1 * 9/2010 Onuma ..... G03G 15/80 399/107
2010/0246109 A1 * 9/2010 Matsubara ..... G03G 21/1633 361/679.01
2013/0009359 A1 * 1/2013 Yamada ..... G03G 15/6502 271/264
2015/0248105 A1 * 9/2015 Aoi ..... G03G 21/1633 399/110

* cited by examiner

IMAGE FORMING APPARATUS AND SHEET CONVEYING DEVICE

INCORPORATION BY REFERENCE

This application is based on and claims the benefit of priority from Japanese Patent application No. 2014-084279 filed on Apr. 16, 2014, the entire contents of which are incorporated herein by reference.

BACKGROUND

The present disclosure relates to a sheet conveying device, such as a relay conveying unit which conveys a sheet on which image is formed to a post-processing device, and an image forming apparatus which includes this sheet conveying device.

There is a post-processing device which performs post-processing, such as staple processing and hole punching processing, on a sheet on which image is formed by an image forming apparatus, such as a copy machine or a multifunction peripheral. Meanwhile, an image forming apparatus provided with an internal sheet discharge portion in which a sheet is ejected is spreading to meet a demand for miniaturization.

When a post-processing device is jointed to an image forming apparatus having an internal sheet discharge portion, a relay conveying unit is required to form a conveying path for a sheet traveling from the image forming apparatus to the post-processing device. The relay conveying unit is generally provided with an openable cover to perform processing for jammed sheet.

The relay conveying unit is arranged in the internal sheet discharge portion of the image forming apparatus, and, if the height of the image forming apparatus is lowered for miniaturization, the height of the internal sheet discharge portion also lowers. Hence, it is difficult to secure a sufficient opening/closing angle of the cover in the relay conveying unit arranged in the internal sheet discharge portion, and therefore a jammed sheet needs to be processed in a narrow space.

Hence, there is an image forming apparatus including a relay processing unit in which a cover member is configured to turn in parallel by a link mechanism to open a conveying path with an uniform height over the entire area of the conveying path.

Generally, on a lower surface of the cover of the relay conveying unit, a plurality of projections, such as a positioning boss, a pressing projection which presses a switch of an opening/closing detector, and a hook projection which keeps the cover member in the closing state, is provided. A plurality of these projections may obstruct an operation for processing jammed sheet in a narrow space, and therefore the number of projections is preferably small as much as possible. However, this problem cannot be solved even if the cover member can be opened and closed in parallel as in the above-described image forming apparatus.

SUMMARY

In accordance with an embodiment of the present disclosure, an image forming apparatus includes an apparatus main body and a relay conveying unit. The apparatus main body is provided with an internal sheet discharge portion in which a sheet on which image is formed is ejected. The relay conveying unit is arranged in the internal sheet discharge portion and configured to convey the sheet to a post-processing device. The relay conveying unit has: a body portion; a cover member; a detection switch; and a hook. The cover member is configured to form a sheet conveying path together with the body portion and provided on a side surface of the body portion so as to be turnable in vertical directions around a hinge shaft into an opening state where the sheet conveying path is opened and a closing state where the sheet conveying path is formed. The detection switch is configured to detect the opening/closing state of the cover member by being switched between an on state and an off state. The hook is provided on the cover member and configured to engage with the body portion to prevent the cover member from being turned from the closing state and to switch the detection switch into the on state.

In accordance with an embodiment of the present disclosure, the relay conveying unit includes: a body portion; a cover member; a detection switch; and a hook. The cover member is configured to form a sheet conveying path together with the body portion and provided on a side surface of the body portion so as to be turnable in vertical directions around a hinge shaft into an opening state where the sheet conveying path is opened and a closing state where the sheet conveying path is formed. The detection switch is configured to detect the opening/closing state of the cover member by being switched between an on state and an off state. The hook is provided on the cover member and configured to engage with the body portion to prevent the cover member from being turned from the closing state and to switch the detection switch into the on state.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to the present disclosure be described.

Figure 1:
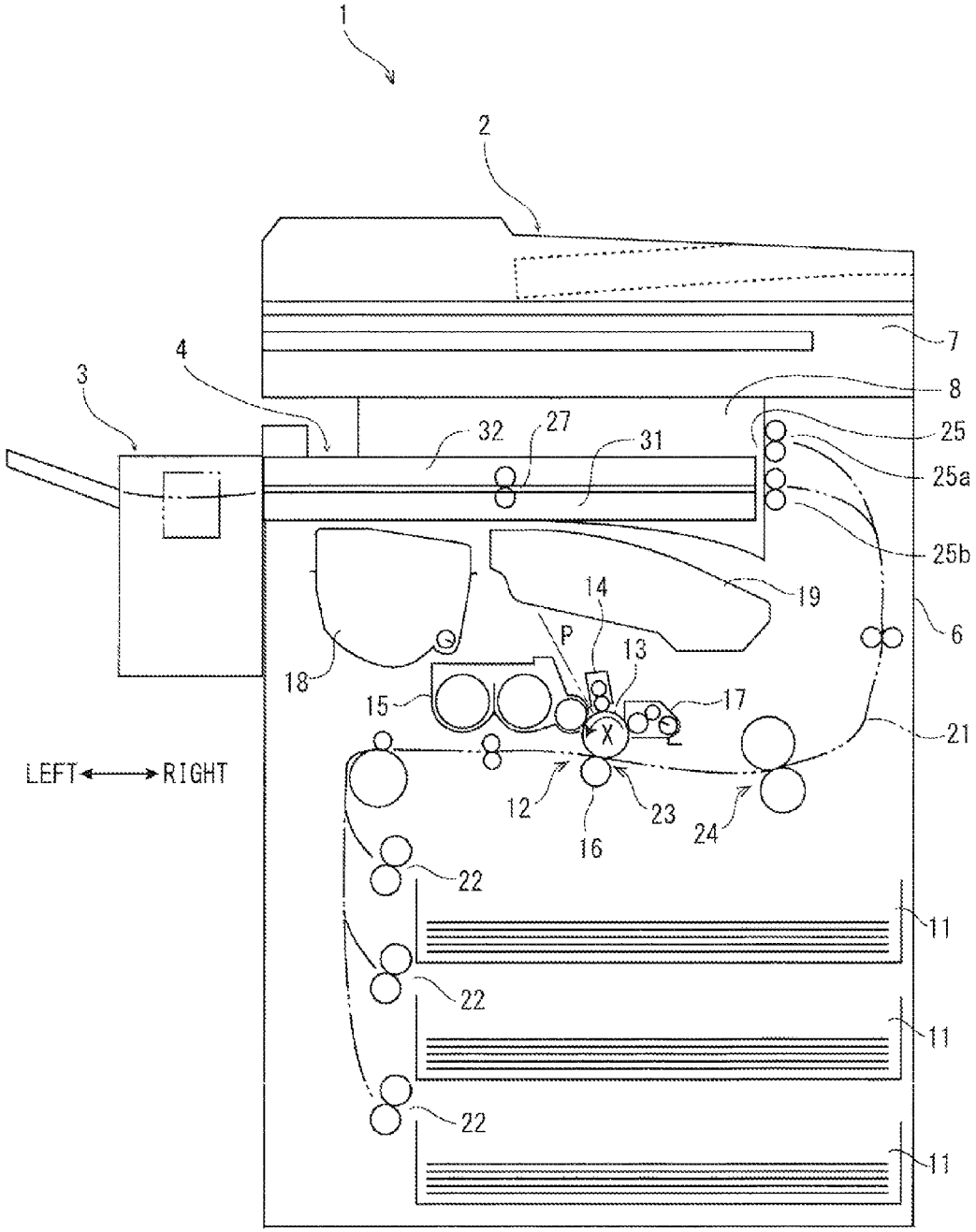
FIG. 1 is a front view schematically showing a configuration of an image forming apparatus according to one embodiment of the present disclosure.

First, with reference to FIG. 1, an entire structure of an image forming apparatus 1 will be described. FIG. 1 is a sectional view schematically showing an internal structure of the printer according to an embodiment of the present disclosure. Hereinafter, a front side in FIG. 1 indicates a front side of the image forming apparatus 1 and left and right directions are described on the basis of a direction when the image forming apparatus 1 is viewed from the front side.

The image forming apparatus 1 includes an apparatus main body 2 which performs image forming processing and a relay conveying unit 4 (sheet conveying device) conveying a sheet on which image is formed to a post-processing device 3.

The apparatus main body 2 has a box-like shaped housing 6. At an upper end of the housing 6, an image reading device 7 is arranged, and, under the image reading device 7, an internal sheet discharge portion 8 with opened front and left faces is formed.

On the left side of the internal sheet discharge portion 8, a post-processing device 3 is attached. The post-processing device 3 may include a hole punching device performing hole punching for sheet, a staple processing device performing binding sheets and the others. Explanation of the hole punching device and the staple processing device is omitted.

Inside the housing 6, three sheet feeding cassettes 11 storing sheets (not shown) are arranged in the upward and downward directions at the lower space. Above the sheet feeding cassettes 11, an image forming part 12 is provided. In the image forming part 12, a photosensitive drum 13 as an image carrier is rotatably provided. Around the photosensitive drum 13, a charging device 14, a development device 15, a transfer roller 16 and a cleaning device 17 are located in order along a rotating direction of the photosensitive drum 13. Above the image forming part 12, a toner container 18 connected to the development device 15 is installed and, on the right side of the toner container 18, an exposure device 19 consisting of laser scanning unit (LSU) is provided.

Inside the housing 6, a conveying path 21 extending from the sheet feeding cassettes 11 toward the internal sheet discharge portion 8 is formed. Along the conveying path 21, a sheet feeder 22 corresponding each sheet feeding cassette 11, a transferring part 23 formed between the photosensitive drum 13 and the transfer roller 16, a fixing device 24 and a sheet ejecting part 25 located on the right side of the internal sheet discharge portion 8 are provided in order from an upstream side of the sheet conveying path 21. The sheet ejecting part 25 has a normal processed sheet ejection port 25*a* and a sheet to be post-processed ejection port 25*b*. The sheet to be post-processed ejection port 25*b* is located under the normal processed sheet ejection port 25*a*.

Next, an image forming operation of the image forming apparatus 1 having the above structure will be described.

When the power is supplied to the image forming apparatus 1, initial determination, such as temperature determination of the fixing device 24, is carried out. Subsequently, in the image forming apparatus 1, when a printing start is directed, image forming operation is carried out as follows.

First, the surface of the photosensitive drum 13 is electric-charged by the charging device 14. Then, photographic exposure corresponding to image data on the photosensitive drum 13 is carried out by a laser light (refer to a two-dot chain line p in FIG. 1) from the exposure device 19, thereby forming an electrostatic latent image on the surface of the photosensitive drum 13. Subsequently, the development device 15 develops the electrostatic latent image to a toner image by a toner (a developer) supplied from the toner container 18.

On the other hand, the sheet fed from suitable sheet feeding cassette 11 by the sheet feeder 22 is conveyed to the transferring part 23 along the sheet conveying path 21 in a suitable timing for the above-mentioned image forming operation, and then, the toner image on the photosensitive drum 13 is transferred onto the recording sheet in the transferring part 23. The recording sheet with the transferred toner image is conveyed to a downstream side in the conveying path 21 and goes into the fixing device 24, and then, the toner image is fixed on the recording sheet in the fixing device 24. The recording sheet with the fixed toner image is ejected from the sheet ejection port 25*a* or 25*b*. The toner remained on the photosensitive drum 13 is collected by the cleaning device 17.

Figure 2:
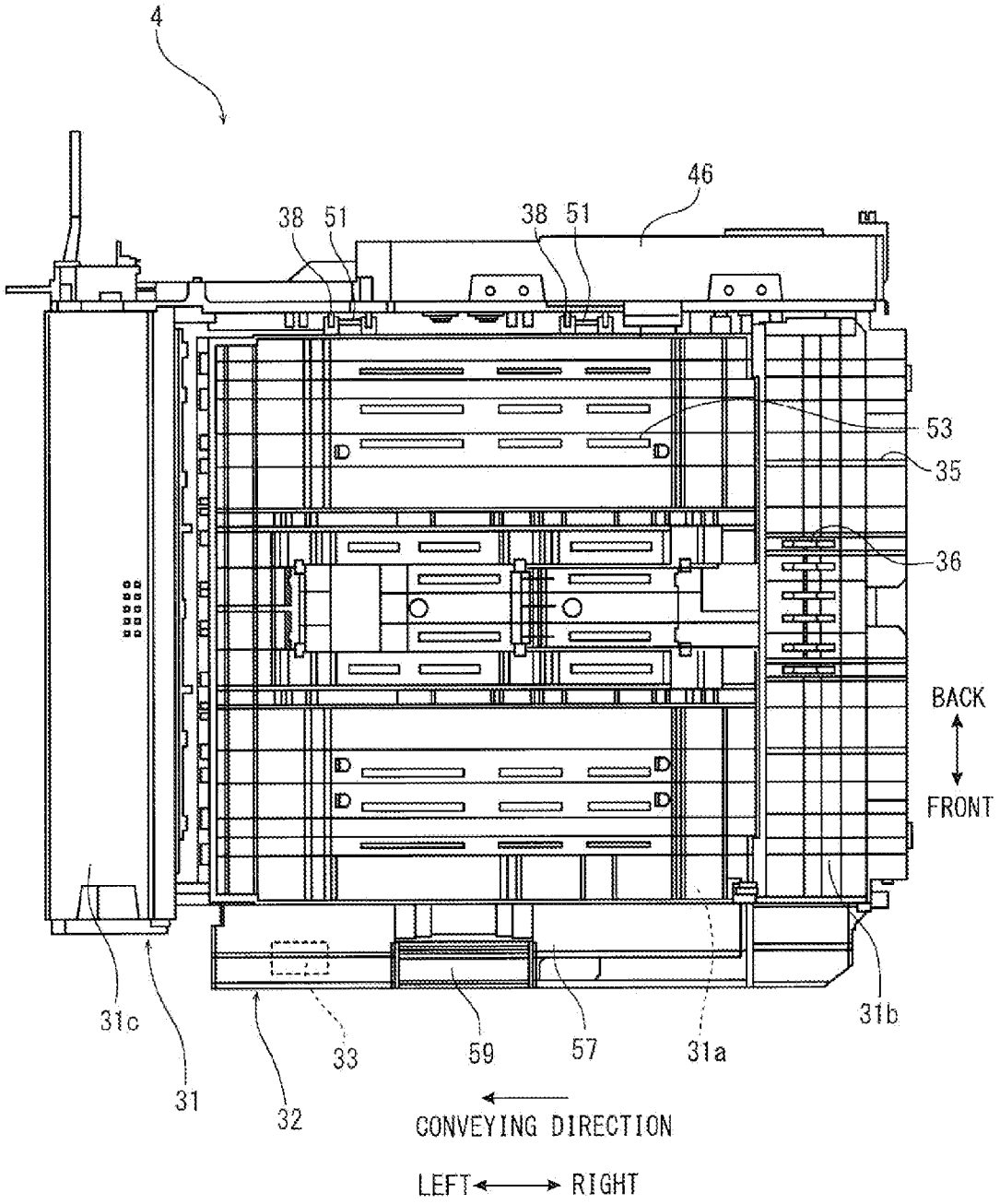
FIG. 2 is a plan view of a relay conveying unit of the image forming apparatus according to one embodiment of the present disclosure.
Figure 4:
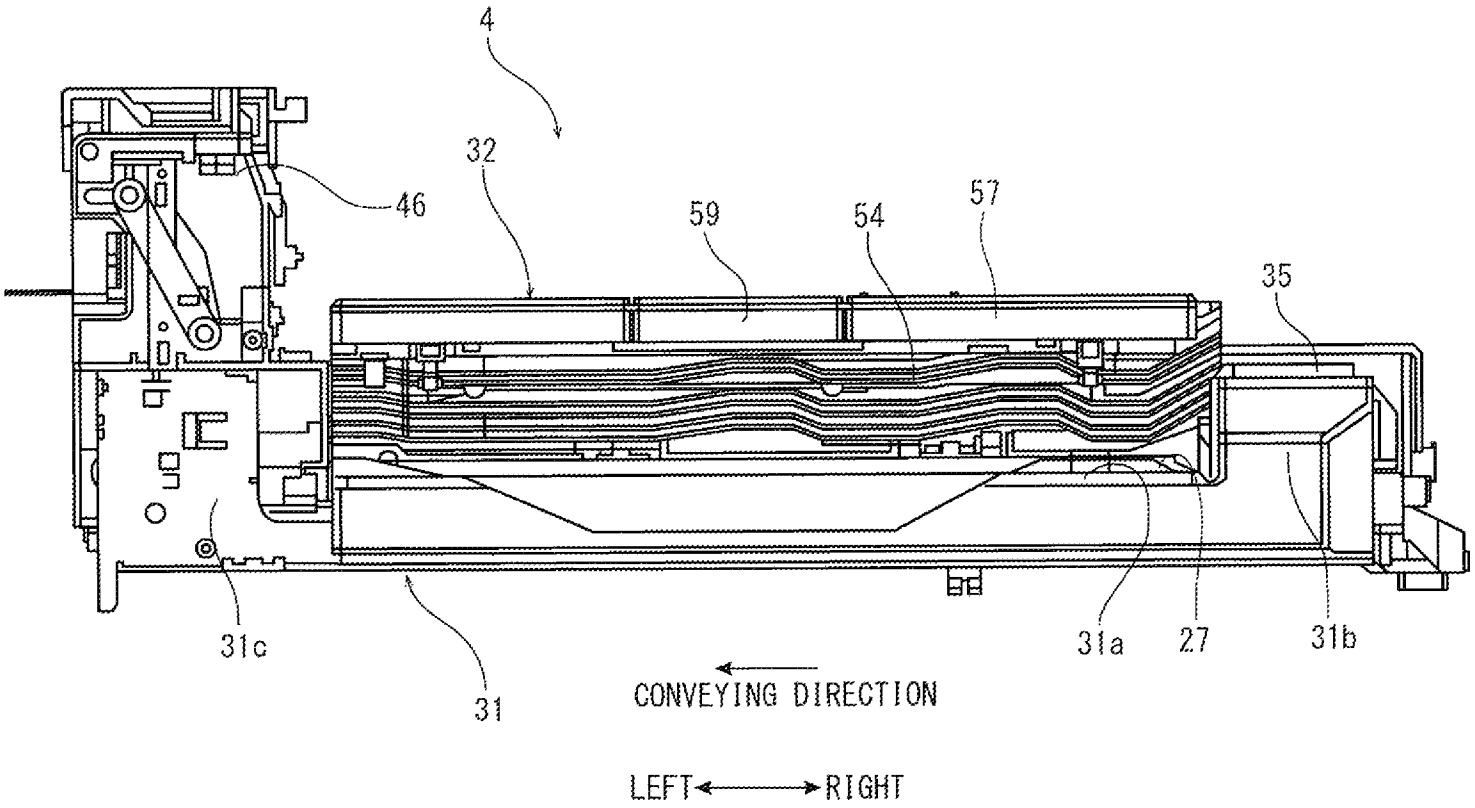
FIG. 4 is a front view showing the relay conveying unit with a cover member opened, in the image forming apparatus according to one embodiment of the present disclosure.
Figure 5:
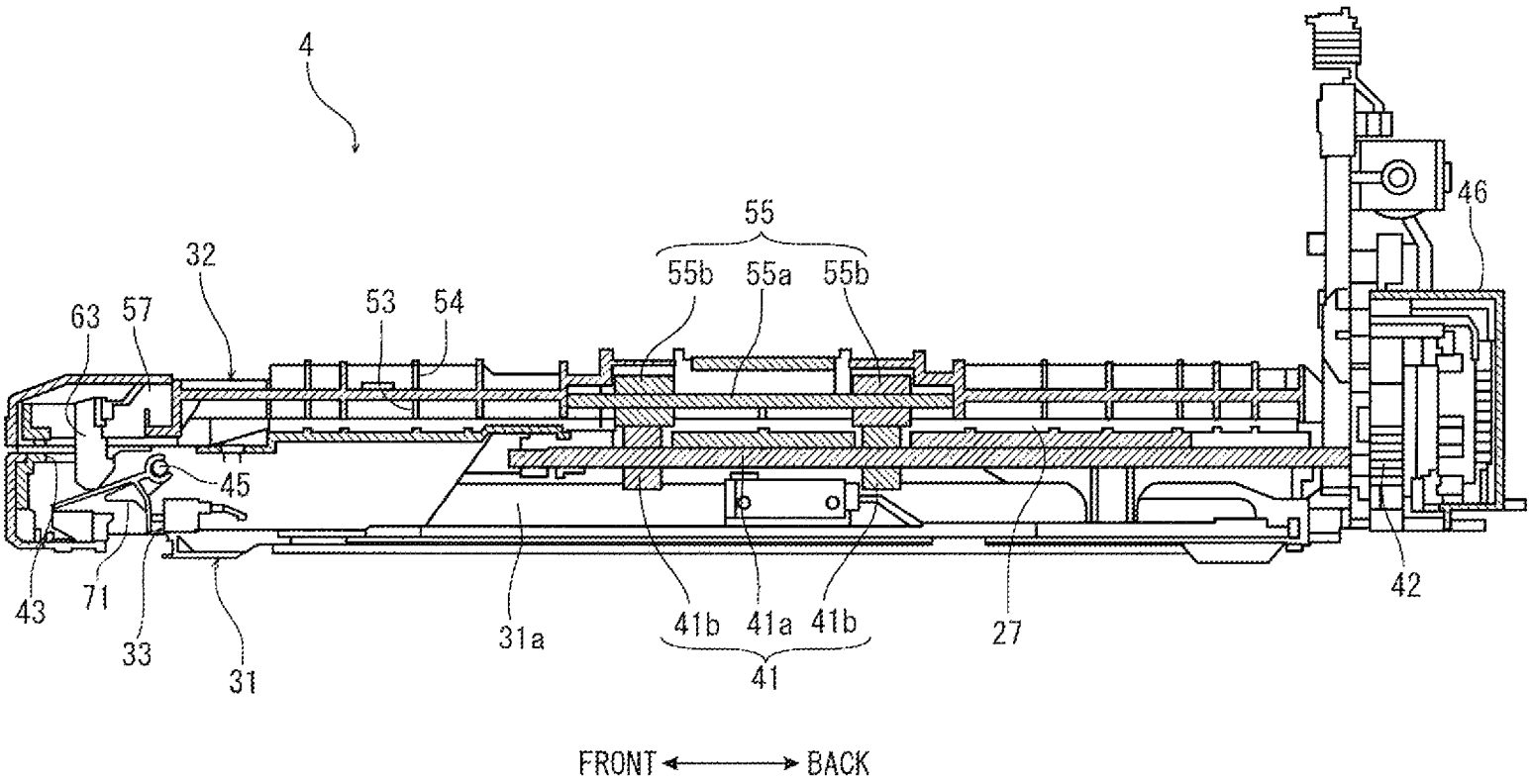
FIG. 5 is a side sectional view of the relay conveying unit of the image forming apparatus according to one embodiment of the present disclosure.
Figure 6:
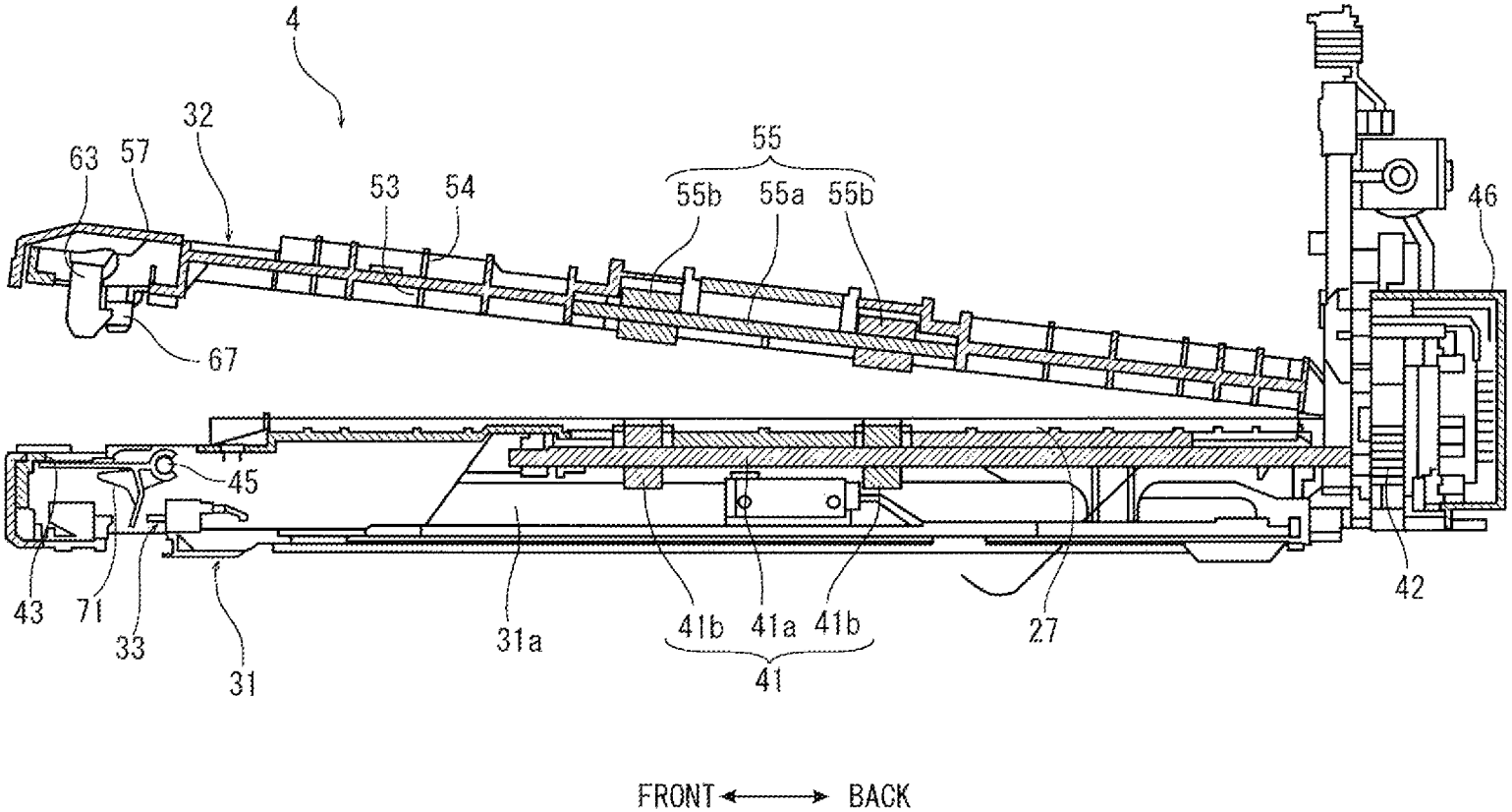
FIG. 6 is a lateral sectional view showing the relay conveying unit with the cover member in the opening state, in the image forming apparatus according to one embodiment of the present disclosure.
Figure 7:
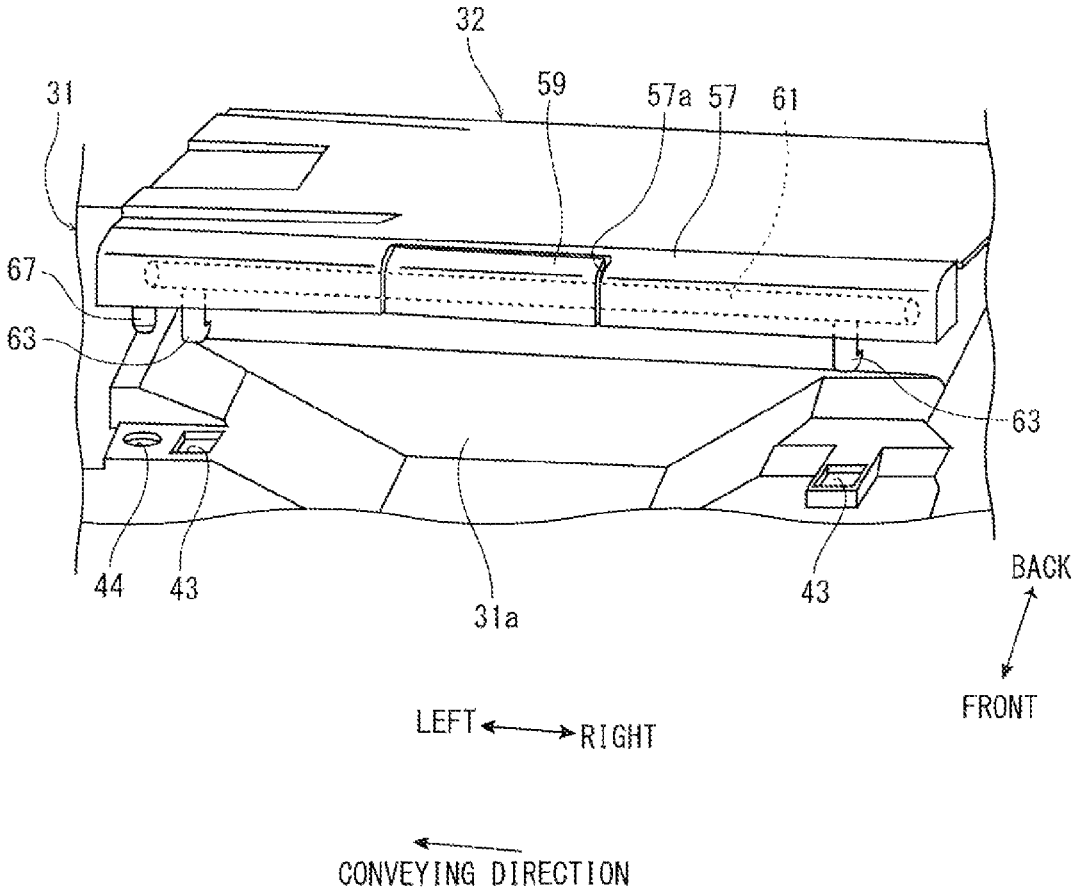
FIG. 7 is a perspective view seen from a front side showing the relay conveying unit with the cover member in the opening state, in the image forming apparatus according to one embodiment of the present disclosure.
Figure 8:
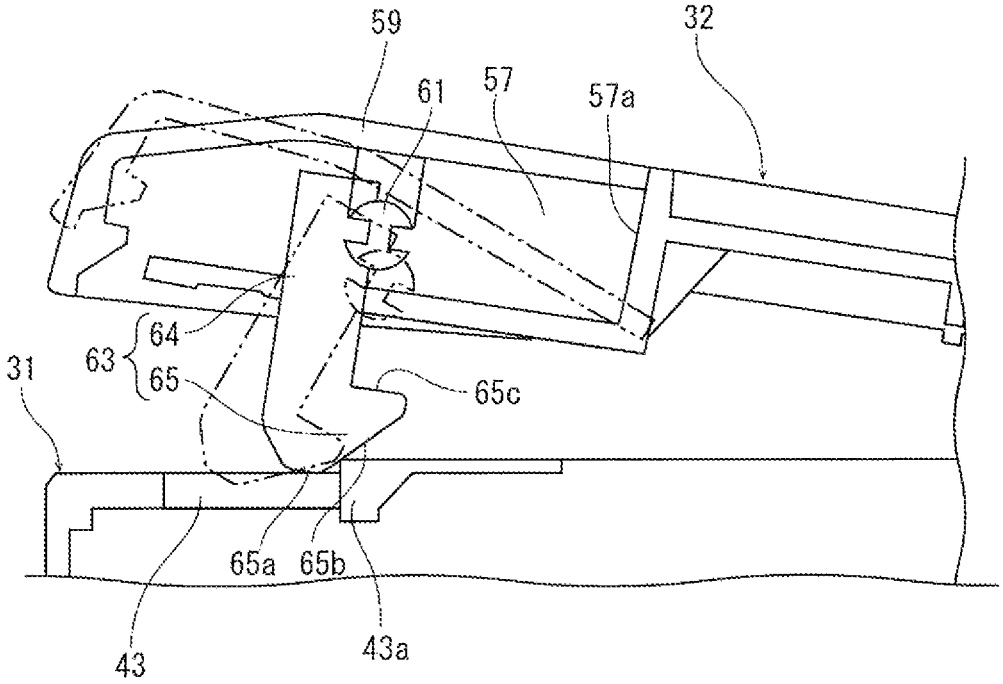
FIG. 8 is a side sectional view showing an opening/closing operation grip of the cover member of the relay conveying unit, in the image forming apparatus according to one embodiment of the present disclosure.
Figure 9A:
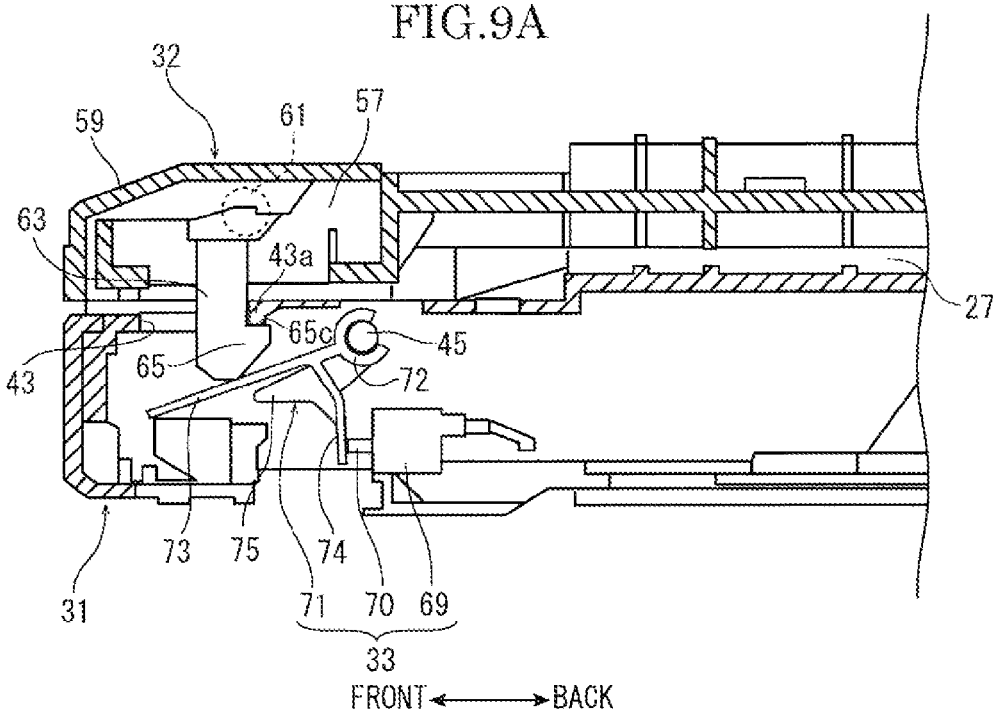
FIG. 9A is a lateral view showing a detecting operation of a detection switch in a state where the cover member is turned into the closing state, in the relay conveying unit in the image forming apparatus according to one embodiment of the present disclosure.
Figure 9B:
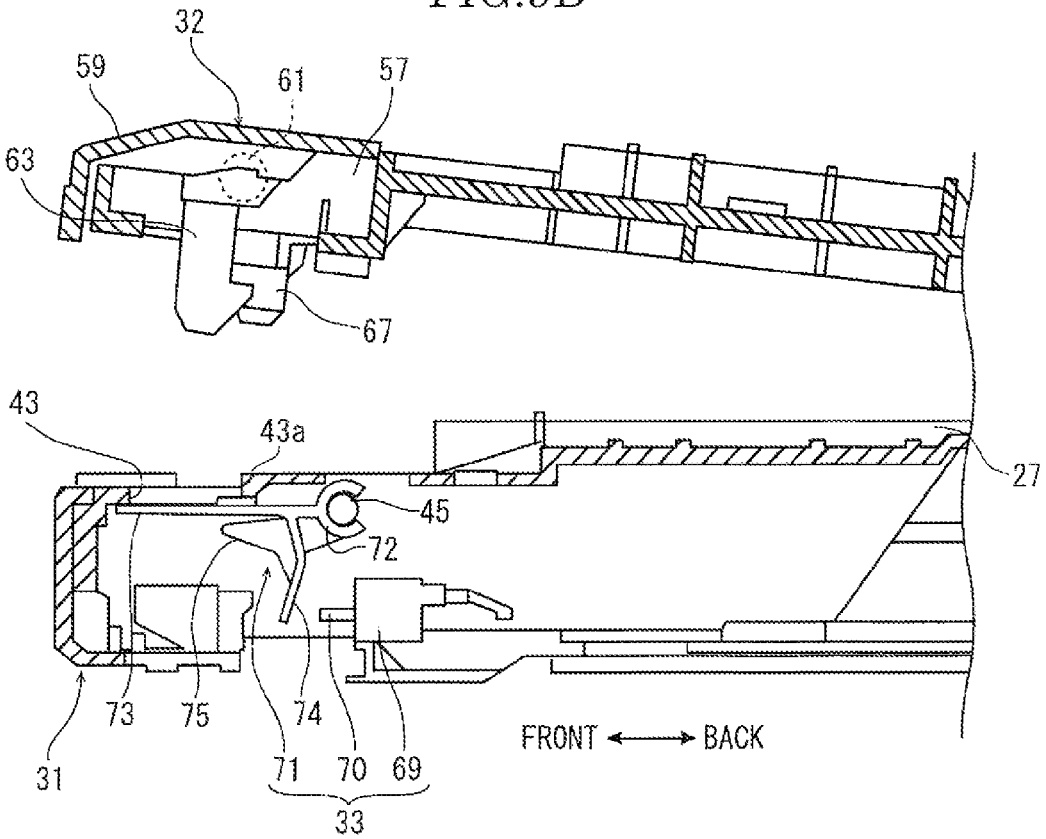
FIG. 9B is a lateral view showing the detecting operation of the detection switch in a state where the cover member is turned into the opening state, in the relay conveying unit in the image forming apparatus according to one embodiment of the present disclosure.

Next, the relay conveying unit 4 will be described with reference to FIGS. 2 to 9. FIG. 2 is a plan view of the relay conveying unit, FIG. 3 is a front view of the relay conveying unit, FIG. 4 is a front view showing the relay conveying unit with the conveying path opened by turning the cover, FIG. 5 is a side sectional view of the relay conveying unit, FIG. 6 is a side sectional view showing the relay conveying unit with the conveying path opened by turning the cover, FIG. 7 is a perspective view showing the relay conveying unit with the cover opened by turning the cover seen from the front side and, FIG. 8 is a side view showing an opening/closing operation grip of the cover, FIG. 9A is a side view showing a detecting operation of a detection switch in a state where the conveying path is closed, and FIG. 9B is a side view showing the detecting operation of the detection switch in a state where the conveying path is opened.

The relay conveying unit 4 is formed in an approximately flat rectangular parallelepiped shape and is arranged in the internal sheet discharge portion 8 of the apparatus main body 2 (shown in FIG. 1). The relay conveying unit 4 includes a body portion 31, a cover member 32 which forms a sheet conveying path 27 together with the body portion 31 and is configured to open and close the conveying path 27, and a detection switch 33 which is positioned inside the body portion 31 and detects an opening/closing state of the cover member 32.

Figure 3:
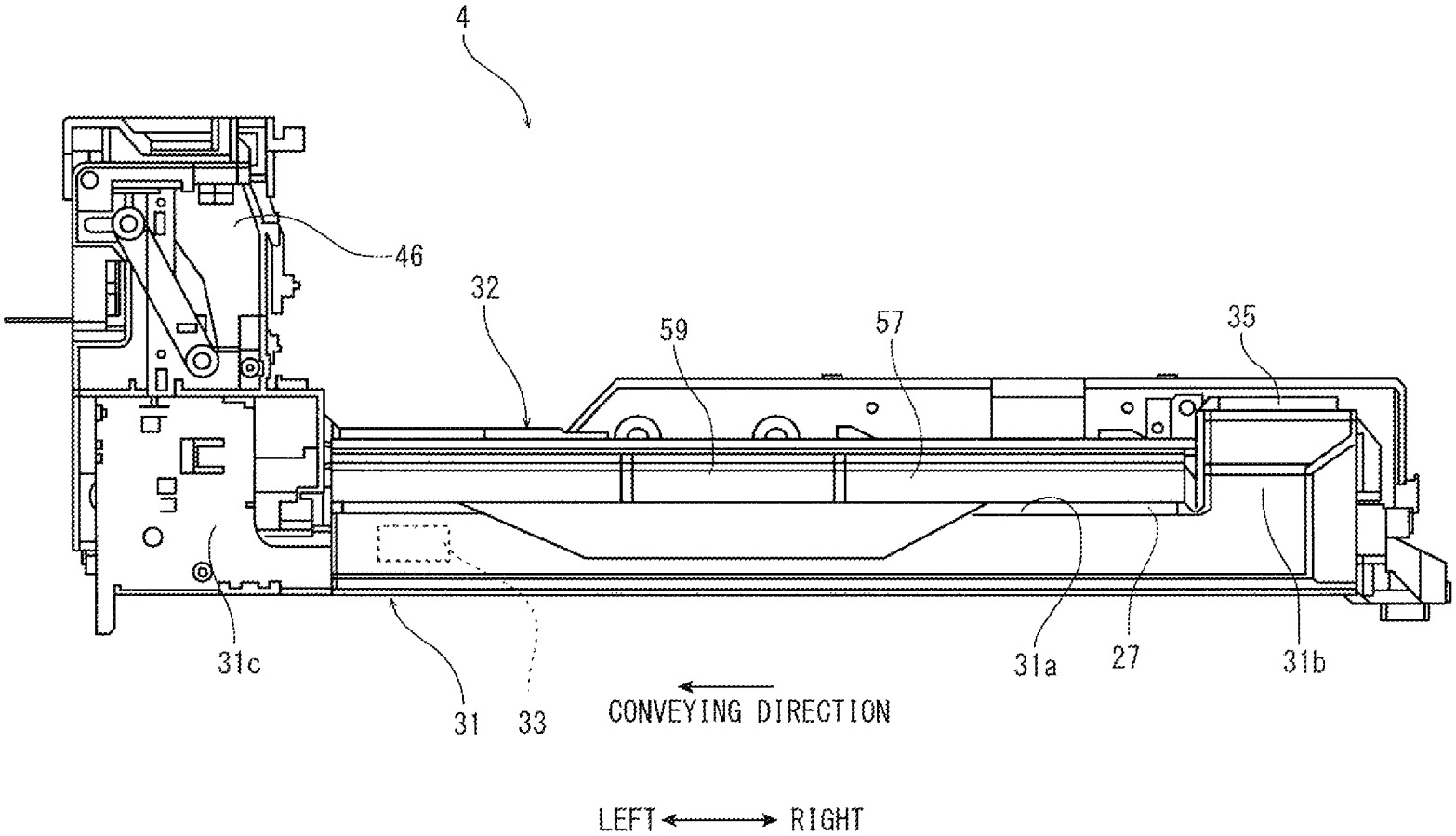
FIG. 3 is a front view of the relay conveying unit of the image forming apparatus according to one aspect of the present disclosure.

As shown in FIGS. 2 and 3, the body portion 31 has an approximately rectangular parallelepiped box-like shape. On an upper surface of the body portion 31, a shallow recessed part 31*a* is formed along a width direction orthogonal to a conveying direction. At a right side base part 31*b* on a right side of the recessed part 31*a*, a reception port (not shown) which receives a sheet ejected from the sheet to be post-processed ejection port 25*b* of the apparatus main body 2 is formed along the width direction, and, at a left side base part 31*c* on a left side of the recessed part 31*a*, a transfer port (not shown) which transfers the sheet to the post-processing device 3 is formed along the width direction.

A plurality of ribs (not shown) is formed along the conveying direction at predetermined intervals on a bottom surface of the recessed part 31*a*. Further, on an upper surface of the right side base part 31*b*, a plurality of ribs 35 is formed along the conveying direction at predetermined intervals. Furthermore, a plurality of rollers 36 which rotates in the conveying direction is supported on the upper surfaces of the recessed part 31*a*, the right side base part 31*b* and the left side base part 31*c*. At a rear edge of the recessed part 31*a*, bearing parts 38 each having an axial hole extending in a direction parallel to the conveying direction are formed.

As shown in FIGS. 5 and 6, on a nearly center of the bottom surface of the recessed part 31*a* in the conveying direction, a conveying roller 41 is supported rotatably in the conveying direction. The conveying roller 41 has a rotating shaft 41*a* extending in the forward and backward directions, and two roller main body parts 41*b* attached to a nearly center of the rotating shaft 41*a* with a predetermined interval spaced each other. A rear end portion of the rotating shaft 41*a* projects backwardly from the recessed part 31*a*, and a gear 42 is fixed to the rear end portion.

At a front left corner and a front right corner of the recessed part 31*a*, a rectangular opening 43 is formed respectively. Further, as shown in FIG. 7, on a left side of the opening 43 formed at the front left corner of the recessed part 31*a*, a circular depression 44 is formed. Furthermore, inside the body portion 31, a bearing part 45 parallel to the conveying direction is formed on the back side of the opening 43.

As shown in FIGS. 2 and 3, a hollow housing 46 is provided along a rear surface of the body portion 31. In the housing 46, a gear train meshing with a gear 42 fixed to the rear end portion of the rotating shaft 41*a* of the conveying roller 41, a motor and the like are housed. The conveying roller 41 is rotated via the gear train and the gear 42 when the motor rotates.

The cover member 32 is a flat-plate like member of the substantially same rectangular planar shape of the recessed part 31*a* of the body portion 31, and is supported by the recessed part 31*a* of the body portion 31 so as to be turnably around the rear side as a support point.

As shown in FIG. 2, at a rear edge of the cover member 32, hinge shafts 51 parallel to the conveying direction are provided. The hinge shafts 51 are axially supported by the bearing parts 38 formed at the rear edge of the recessed part 31*a* of the body portion 31. The cover member 32 turns around the hinge shafts 51 as support points. When the cover member 32 turns toward the recessed part 31*a* into the closing state, the sheet conveying path 27 between the upper surface of the recessed part 31*a* and a lower surface of the cover member 32 is formed and the upper surface comes to the same height as the upper surfaces of the left side base part 31*c* and the right side base 31*b* of the body portion 31. When the cover member 32 turns toward a side spaced away from the recessed part 31*a* into the opening state, the sheet conveying path 27 is opened and, therefore, it becomes possible to process jammed sheet.

On an upper surface of the cover member 32, a plurality of ribs 53 is formed along the conveying direction at predetermined intervals to form an ejected sheet tray together with the upper surface of the right side base part 31*b* of the body portion 31. To the ejected sheet tray, a sheet ejected from the normal processed sheet ejecting port 25*a* of the apparatus main body 2 is received. As shown in FIG. 4, on the lower surface of the cover member 32, a plurality of ribs 54 is also formed along the conveying direction at predetermined intervals.

Further, as shown in FIGS. 5 and 6, on the lower surface of the cover member 32, a conveying roller 55 is rotatably supported in the conveying direction at a nearly center in the conveying direction. The conveying roller 55 includes a rotating shaft 55*a* extending in a width direction and two roller main body parts 55*b* attached to the rotating shaft 55*a* with a predetermined interval spaced in the nearly center. The two roller main body parts 55*b* are positioned to meet the roller main body parts 41*b* of the conveying roller 41 supported by the body portion 31.

Along a front edge of the cover member 32, a hollow edge part 57 of an approximately rectangular parallelepiped flat shape is formed. As shown in FIG. 7 and others, at a nearly center of the hollow edge part 57 in the conveying direction, a rectangular cutout part 57*a* formed by partially cutting out an upper portion and a front portion of the hollow edge part 57 is formed. In this cutout part 57*a*, an opening/closing operation grip 59 of the cover member 32 is attached. As shown in FIG. 8, the opening/closing operation grip 59 has a shape meeting a shape of the cutout part 57*a*. On an inner surface of the opening/closing operation grip 59, a supporting shaft 61 parallel to the hinge shafts 51 of the cover member 32 is fixed. The supporting shaft 61 is rotatably supported in the hollow edge part 57, and the opening/closing operation grip 59 turns around the supporting shaft 61 between an opening position (as shown in a dashed-two dotted line in FIG. 8) spaced apart from the cutout part 57*a* and a closing position (as shown in a solid line in FIG. 8) housed in the cutout part 57*a*. The supporting shaft 61 is biased to rotate in a counterclockwise direction in FIG. 8 by a helical torsion coil spring or the like (not shown) and thereby to biases the opening/closing operation grip 59 toward the closing position.

At left and right end portions of the supporting shaft 61, hooks 63 are formed respectively, as shown in FIG. 7. As shown in FIG. 8, the hook 63 is formed in a claw shape having a base portion 64 projecting downward at a nearly right angle from a lower surface of the hollow part 57 at the closing position of the opening/closing grip 59 and a claw portion 65 extending rearward from a tip end of the base portion 64. The claw portion 65 has a lower surface 65*a*, including an inclined surface 65*b* extending rearward in a diagonally upper direction, and an upper surface 65*c*. The respective hooks 63 are positioned to meet the openings 43 (as shown in FIG. 7) formed at the front left corner and the front right corner of the recessed part 31*a* of the body portion 31 when the cover member 32 is turned into the closing state.

As shown in FIG. 7, on the lower surface of the cover member 32, a boss 67 projecting downward is formed on a left side of the left hook 63. The boss 67 is positioned to meet the depression 44 formed at the front left corner of the recessed part 31*a* of the body portion 31 when the cover member 32 is turned into the closing state.

As shown in FIG. 9, the detection switch 33 includes a rectangular parallelepiped shaped switch body 69 which is switched between an on state and an off state, a switching piece 70 provided so as to project or retract in a horizontal direction (forward and backward directions) toward the switch body 69, and a lever member 71 interposed between the hook 63 and the switching piece 70 and supported turnably in the vertical (upward and downward) directions. The switch body 69 is arranged inside the body portion 31 on a back side of the opening 43 formed at the front left corner of the recessed part 31*a* with the switching piece 70 on the front side.

The lever member 71 is supported by the bearing part 45 formed in parallel to the supporting shaft 61 of the hooks 63 on a back side of the opening 43 so as to be turnable in the upward and downward directions, and has a rotating shaft part 72 supported by the bearing part 45, a pressure receiving piece 73 extending forward beyond the opening 43 from the rotating shaft part 72 to oppose to the hook 63, a pressing piece 74 branched downward from the pressure receiving piece 73 at a position close to the rotating shaft part 72 to oppose to the front of the switching piece 70 of the detection switch 33, and a flat support piece 75 provided in a surrounding of a branching part of the rotating shaft part 72, the pressure receiving piece 73 and the pressing piece 74. The lever member 71 is biased to be turned in the clockwise direction in FIG. 9 around the rotating shaft part 72 by a helical torsion coil spring or the like (not shown).

An operation of turning the cover member 32 in the relay conveying unit 4 having the above-described configuration will be described with reference to FIG. 9 and others.

When a post-processing is not performed and a sheet is normally ejected, in a state where the cover member 32 is turned into the closing state, a sheet is ejected from the normal processed sheet ejecting port 25*a* of the apparatus main body 2 onto the upper surface of the right side base part 31*b* of the body portion 31 of the relay conveying unit 4 and onto the upper surface of the cover member 32. When a post-processing is performed, a sheet is ejected from the sheet to be post-processed ejecting port 25*b* and enters the conveying path 27 between the lower surface of the cover member 32 and the bottom surface of the recessed part 31*a* of the body portion 31 from the sheet reception port formed at the right side base part 31*b* of the relay conveying unit 4. Then, the sheet is conveyed by the conveying rollers 41 and 55 to the sheet transfer port formed at the left side base part 31*c*, and is fed to the post-processing device 3. Subsequently, the sheet is subjected to predetermined post-processing by the post-processing device 3 and then ejected.

Further, in a state where the cover member 32 is turned into the closing state, as shown in FIG. 9A, the hooks 63 provided in the cover member 32 are inserted through the openings 43 formed at the front left corner and the front right corner of the recessed part 31*a* of the body portion 31, respectively, and the claw portions 65 engage with the rear edges 43*a* of the openings 43 to prevent from the cover member 32 from the closing state. Furthermore, the lower surface of the claw portion 65 of the hook 63 presses the pressure receiving piece 73 of the lever member 71 to keep the pressing piece 70 pressing the switching piece 70 of the detection switch 33 against a biasing force of the helical torsion coil spring. Thus, the detection switch 33 is switched into the on state, and detects a state where the cover member 32 is turned into the closing state.

Thus, in a state where the cover member 32 is turned into the closing state, when a sheet is jammed at the conveying path 27, in order to process for removing the jammed sheet, the cover member 32 is turned in a direction to open the conveying path 27 of the body portion 31 while turning the opening/closing operation grip 59 of the cover member 32 upward (as shown in the dashed-two dotted line in FIG. 8). Then, the hooks 63 turn around the supporting shaft 61 together with the opening/closing operation grip 59 and are separated away from the rear edges 43*a* of the openings 43 to release the engagement of the cover member 32 with the main body part 31. This makes it possible to turn the cover member 32 around the hinge shafts 51.

Hence, when the cover member 32 is turned while turning the opening/closing operation grip 59 upward as described above, as shown in FIG. 9B, the hook 63 is spaced away from the pressure receiving piece 73 of the lever member 71 through the opening 43 of the body portion 31. Thus, the lever member 71 is biased in the clockwise direction in FIG. 9B by the helical torsion coil spring, and the opening 43 of the body portion 31 is closed from the below with the pressure receiving piece 73.

Further, in this case, the pressing piece 74 is spaced away from the switching piece 70 of the detection switch 33 forward. Thus, since the pressing of the lever member 71 against the switching piece 70 is released, the switching piece 70 moves forward from the switch body 69. Then, the detection switch 33 is switched into the off state and detects a state where the cover member 32 is turned into the opening state. In addition, when the opening/closing operation grip 59 is released after the cover member 32 is turned, the opening/closing operation grip 59 turns by being biased by the helical torsion coil spring, and returns into the original position.

In a state where the cover member 32 is turned into the opening state described above, after the processing for removing the jammed sheet is finished, when the cover member 32 is turned downward into the closing state, the hook 63 of the cover member 32 presses the pressure receiving piece 73 of the lever member 71 downward to turn the lever member 71 in the counterclockwise direction in FIG. 9B around the rotating shaft part 72 against the biasing force of the helical torsion coil spring. In particular, as shown in FIG. 8, the inclined surfaces 65*b* of the claw portions 65 of the hooks 63 come into contact with the rear edges 43*a* of the openings 43 of the body portion 31 and are pressed against the rear edges 43*a* while sliding on the rear edges 43*a*. Then, the hooks 63 begin to turn upward around the supporting shaft 61. That is, the opening/closing operation grip 59 begins to turn upward.

When the cover member 32 is further turned downward, after the claw portion 65 of the hook 63 passes through the opening 43, the hook 63 is biased by the helical torsion coil spring and then the upper surface 65*c* of the claw portion 65 is engaged with the rear edge 43*a* of the opening 43. Thus, the opening/closing operation grip 59 is turned to close the cutout part 57*a*. At the same time in which the under surface 65*a* of the claw portion 65 of the hook 63 passes through the opening 43, the pressure receiving piece 73 of the lever member 71 is pressed with the under surface 65*a* of the claw portion 65 so as to turn the lever member 71 in the counterclockwise direction in FIG. 9B around the rotating shaft part 72. Thus, the pressing piece 74 of the lever member 71 presses the switching piece 70 of the detection switch 33 to move the switching piece 70 backward. This switches the detection switch 33 into the on state to detect a state where the cover member 32 is turned into the closing state.

Further, when the cover member 32 is turned downward as described above, the boss 67 provided in the cover member 32 engages with the depression 44 formed at the left corner of the recessed part 31*a* of the body portion 31 to position the cover member 32 with respect to the body portion 31. In addition, when the cover member 32 is turned downward, since the hooks 63 turns around the supporting shaft 61 and then the claw portions 65 enter through the openings 43 by coming the inclined surfaces 65*b* of the claw portions 65 of the hooks 63 into contact with the rear edges 43*a* of the openings 43*a* as described above, it is not necessary to grip the opening/closing operation grip 59.

As described above, in the relay conveying unit of the image forming apparatus 1 according to one embodiment of the present disclosure, the hook 63 provided in the cover member 32 is configured to engage and disengage the cover member 32 with the body portion 31 and also to operate the detection switch 33 which detects the opening/closing state of the cover member 32. Accordingly, the hook 63 can serve as projections provided separately for the engagement and the disengagement of the cover member 32 with the body portion 31 and for the detecting the opening/closing state of the cover member 32. Consequently, it is possible to reduce the number of projections which obstructs an operation of processing jammed sheet, for example, and to perform such operations smoothly. Further, it is possible to reduce the number of parts of the relay conveying unit 4.

Furthermore, the hook 63 is operated by a natural operation performed by turning the cover member 32 into the opening state with gripping the opening/closing operation grip 59. Accordingly, it is possible to smoothly perform a series of operations of disengaging the cover member 32 with the body portion 31 and then detecting the opening state of the cover member 32 accompanying with the disengagement. Still further, the lever member 71 is configured to turn the upward and downward directions around the bearing part 45 parallel to the supporting shaft 61 of the hook 63. Accordingly, it is possible to smoothly transmit the motion of the hook 63 to the turning of the lever member 71 and to turn the lever member 71 without being loaded, causing increase of detection accuracy of the detection switch.

Further, by interposing the lever member 71 between the hook 63 of the cover member 32 and the switching piece 70 of the detection switch 33, it is possible to convert the downward movement of the hook 63 into the backward movement of the switch piece 70. Thus, it is possible to make the height of the relay conveying unit 4 to be lowered as much as possible in the internal sheet discharge portion 8 having a limited height and to secure a large space above the relay conveying unit 4. Consequently, it is possible to secure a sufficient opening angle of the cover member 32 and therefore to smoothly and easily perform an operation of processing jammed sheet, for example. In addition, a movement direction of the switching piece 70 may not necessarily be the horizontal direction.

Further, if the cover member 32 is configured such that the cover member 32 is positioned with respect to the body portion 31 using the hooks 63 without forming the boss 67, it is possible to further reduce the number of projections provided on the lower surface of the cover member 32 and to realize a more simple structure.

Furthermore, the present embodiment uses the detection switch 33 which is switched between the on state and the off state by pressing and releasing the pressing of the reciprocally movable switching piece 70. However, a photointerrupter, for example, can also be used for the detection switch 33. When the photointerrupter is used, for example, a light emitting unit and a light receiving unit are provided to shut a movement path of the pressing piece 74 and, when the pressing piece 74 moves to a predetermined position, a switch body is switched into the on state.

In the present embodiment, the relay conveying unit 4 arranged in the internal sheet discharge portion of the image forming apparatus 1 has been described as a sheet conveying device. However, the present embodiment is applicable to an image reading device, too, which applies a configuration where a cover member is turned into an opening/closing state.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an apparatus main body provided with an internal sheet discharge portion in which a sheet on which image is formed is ejected; and a relay conveying unit arranged in the internal sheet discharge portion and configured to convey the sheet to a post-processing device, wherein the relay conveying unit includes:

a body portion;

a cover member configured to form a sheet conveying path together with the body portion and provided on a side surface of the body portion so as to be turnable in vertical directions around a hinge shaft into an opening state where the sheet conveying path is opened and a closing state where the sheet conveying path is formed;

a detection switch configured to detect the opening/closing state of the cover member by being switched between an on state and an off state;

a hook provided on the cover member and configured to engage with the body portion to prevent the cover member from being turned in the closing state and to switch the detection switch into the on state; and an opening/closing operation grip provided on the cover member and configured to turn in the vertical directions around a supporting shaft parallel to the hinge shaft of the cover member;

wherein the hook is configured to turn in the vertical directions around the supporting shaft together with the opening/closing operation grip, and when the opening/closing operation grip is turned upward, the engagement of the hook with the body portion is released and the detection switch is switched into the off state.

2. The image forming apparatus according to claim 1, wherein the hook projects downward from the cover member, the detection switch includes:

a switch body configured to be switched between the on state and the off state;

a switching piece configured to project or retract with respect to the switch body; and a turnable lever member interposed between the hook and the switching piece, wherein the lever member has:

a pressure receiving piece provided to oppose to the hook; and a pressing piece provided to oppose to the switching piece, and when the cover member is turned downward into the closing state, the hook presses the pressure receiving piece to turn the lever member such that the pressing piece presses the switching piece to switch the switch body into the on state, and when the cover member is turned upward into the opening state, the hook is separated away from the pressure receiving piece to turn the lever member such that the pressing of the pressing piece against the switching piece is released to switch the switch body into the off state.

3. The image forming apparatus according to claim 2, wherein the switching piece is configured to project or retract in a horizontal direction.

4. The image forming apparatus according to claim 1, wherein the body portion is formed with an opening through which the hook is inserted, the hook has a base portion supported to the supporting shaft and a claw portion projecting from an tip end of the base portion so as to come into contact with an edge of the opening when the cover member is turned downward into the closing state, in which the claw portion has an upper surface and an under surface including an inclined surface, and when the cover member is turned downward, the under surface of the claw portion comes in contact with the edge of the opening and slides on the edge to turn the hook upward around the supporting shaft, after the claw portion passes through the opening, the under surface of the claw portion is separated from the edge of the opening to turn the hook downward around the supporting shaft and then the upper surface of the claw portion engages with the edge of the opening.

5. The image forming apparatus according to claim 4, wherein, the pressure receiving piece of the lever member is pressed with the under surface of the claw portion of the hook to switch the switch body into the on state.

6. The image forming apparatus according to claim 4, wherein, the opening is closed with the pressure receiving piece of the lever member from the below when the cover member is turned into the opening state.

7. The image forming apparatus according to claim 4, wherein, the opening is formed on an upper surface of the body portion.

8. The image forming apparatus according to claim 1, wherein the lever member is provided to turn in the vertical directions around a supporting shaft parallel to the supporting shaft of the hook.

9. A sheet conveying device comprising:

a body portion;

a cover member configured to form a sheet conveying path together with the body portion and provided on a side surface of the body portion so as to be turnable in vertical directions around a hinge shaft into an opening state where the sheet conveying path is opened and a closing state where the sheet conveying path is formed;

a detection switch configured to detect the opening/closing state of the cover member by being switched between an on state and an off state;

a hook provided on the cover member and configured to engage with the body portion to prevent the cover member from being turned in the closing state and to switch the detection switch into the on state; and an opening/closing operation grip provided on the cover member and configured to turn in the vertical directions around a supporting shaft parallel to the hinge shaft of the cover member;

wherein the hook is configured to turn in the vertical directions around the supporting shaft together with the opening/closing operation grip, and when the opening/closing operation grip is turned upward, the engagement of the hook with the body portion is released and the detection switch is switched into the off state.

* * * * *